United States Patent [19]

Leva

[11] 4,421,492

[45] Dec. 20, 1983

[54] ADJUSTABLE FIN SYSTEM

[76] Inventor: Donn W. Leva, Box 166 B-101, Galveston, Tex. 77551

[21] Appl. No.: 274,298

[22] Filed: Jun. 16, 1981

[51] Int. Cl.[3] ..... A63C 15/05

[52] U.S. Cl. ..... 441/79; 114/127; 114/140

[58] Field of Search ..... 441/79, 74; 114/140, 114/127, 132, 141; 403/329, 107

[56] References Cited

U.S. PATENT DOCUMENTS 2,458,076 1/1949 Houston ..... 403/107 X 4,044,416 8/1977 Brewer et al. ..... 441/79

FOREIGN PATENT DOCUMENTS 2746756 4/1978 Fed. Rep. of Germany ..... 441/74

*Primary Examiner*—Sherman D. Basinger

[57] ABSTRACT

A fin system for surfboards, wind surfers or similar sporting equipment having an elongated channel extending lengthwise underneath the board. The fin is adjustable in the channel by the interaction of a resilient finger cut out of the fin base with a ribbed inner surface of the channel. The fin is totally removable from the channel, and when inserted, moves along the channel by pressure applied to the base of the fin. Releasing the pressure on the base causes the resilient finger to engage a notch in the ribbed surface and securely positions the fin at the desired point in the channel.

8 Claims, 5 Drawing Figures

ADJUSTABLE FIN SYSTEM

BACKGROUND OF THE INVENTION

In the past, surfboards had fins mounted and fixed at the rear portion of the board. The trend, however, has been to design a fin that can be adjusted along the length of a channel on the underside of the board. The adjustable feature has become important, because surfers have found that placement of the fin affects an individual's control of the board. Also, it is desirable to have the adjustment capability for varying surf and weather conditions as well as for the individual's preference.

Some adjustable fin systems in the past have relied on the use of screws or moving plates, or other mechanical locking devices to adjust the fin relative to the length of the board. This arrangement requires the surfer to have access to tools such as a screwdriver or wrenches to make a longitudinal adjustment to fasten the fin. This is a limitation on how and when the surfer can adjust the fin. In addition, the necessary mechanical parts for adjusting the fin are subject to corrosion in the salt water environment. In some cases the screw clamps or plates extend beneath the surface of the board creating the possibility of drag on the board.

Other adjustable fin arrangements have avoided the use of tools for the adjustment and substituted complex systems of wedges, keying elements, tabs and flanges as exemplified in U.S. Pat. No. 3,585,663 to Johnson issued June 22, 1971. This more complicated construction does not facilitate manufacturing. Also, some of the fin arrangements, such as on the Johnson patent, have a restricted number of positions along the undersurface of the board for securing the fin, thereby limiting the surfer in the degree of flexibility of longitudinal fin adjustment.

In addition to the adjustability of the fin for the benefit of use of the board, the removable feature of the fin aids in shipping and storage of the surfing equipment. The fin and board can be shipped separately and assembled later. This also gives the surfer the option to use different shapes and sizes of fins.

BRIEF DESCRIPTION OF THE PRESENT INVENTION

The desirability of an easily assembled and adjustable fin system for surfboards, wind surfers and similar sports equipment is recognizable from the foregoing background information. The broad objective of this invention is to provide an adjustable fin system which eliminates the necessity for using tools to adjust the fin, and which avoids a system using keying elements that limit the selection of points along the length of the board for positioning the fin while increasing the difficulty of manufacture. In addition the present invention facilitates the shipping, storage and use of different shapes of fins since the fin is removed easily from the board.

The adjustable fin system utilizes a fin mounting box which can be installed in the rear undersurface of the surfboard during construction of the board. The mounting box has an elongated channel extending lengthwise on the board. The channel has a ribbed inner surface that faces downward when the board is in use and two parallel side walls spaced sufficiently apart to accommodate the base of the fin when the fin is inserted. The channel is also provided on either side with parallel guide slots, which slots widen somewhat as they curve to the surface of the mounting box at the underside of the board.

The fin can be of any shape depending on the type of board and the individual's preference. The fin contains two guide pins that extend through either end of the fin base. The base also has a resilient finger positioned between the two pins created by a slot cut at an angle to the base of the fin. The fin is received in the mounting box by aligning the guide pin closest to the tip of the resilient finger into the guide slots in the channel where the guide slots open to the underside of the board and by applying sufficient pressure to the base of the fin to compress the resilient finger and slide it over the ribbed surface. The slots are widened at the entry point to accommodate the base so that both guide pins are aligned in the guide slots when the fin base is totally inserted in the channel. After the fin base is inserted in the channel, pressure at the fin base is applied to slide the fin into the desired position.

When the base of the fin is positioned, the resilient finger is biased against a notch in the ribbed channel. Pressure on the tip of the fin does not dislodge the placement in the channel. To reposition or remove the fin, it is necessary to apply pressure at the base to compress the resilient finger and slide it over the ribbed surface. The fin is removed in a similar manner to insertion and by sliding the guide pins out of the slots in the channel.

This arrangement gives the user of the adjustable fin system ease in assembling the repositioning the fin without the need for screws, plates or other mechanical parts requiring screwdrivers or wrenches for adjustment. The user can adjust the fin, depending on the water conditions, in the marine environment. The present invention requires few parts that are subject to corrosion from salt water, and the fin assembly can be manufactured using solely nylon or other high strength plastics that are not subject to corrosion. Also, a safety clip can be used with the fin system to block the channel and slots and prevent any accidental dislodgement of the fin from the board.

BRIEF DESCRIPTION OF THE DRAWINGS

The accompanying drawings more fully show the features and objects of the adjustable fin system, in which.

DETAILED DESCRIPTION OF THE PREFERRED EMBODIMENT

Figure 1:
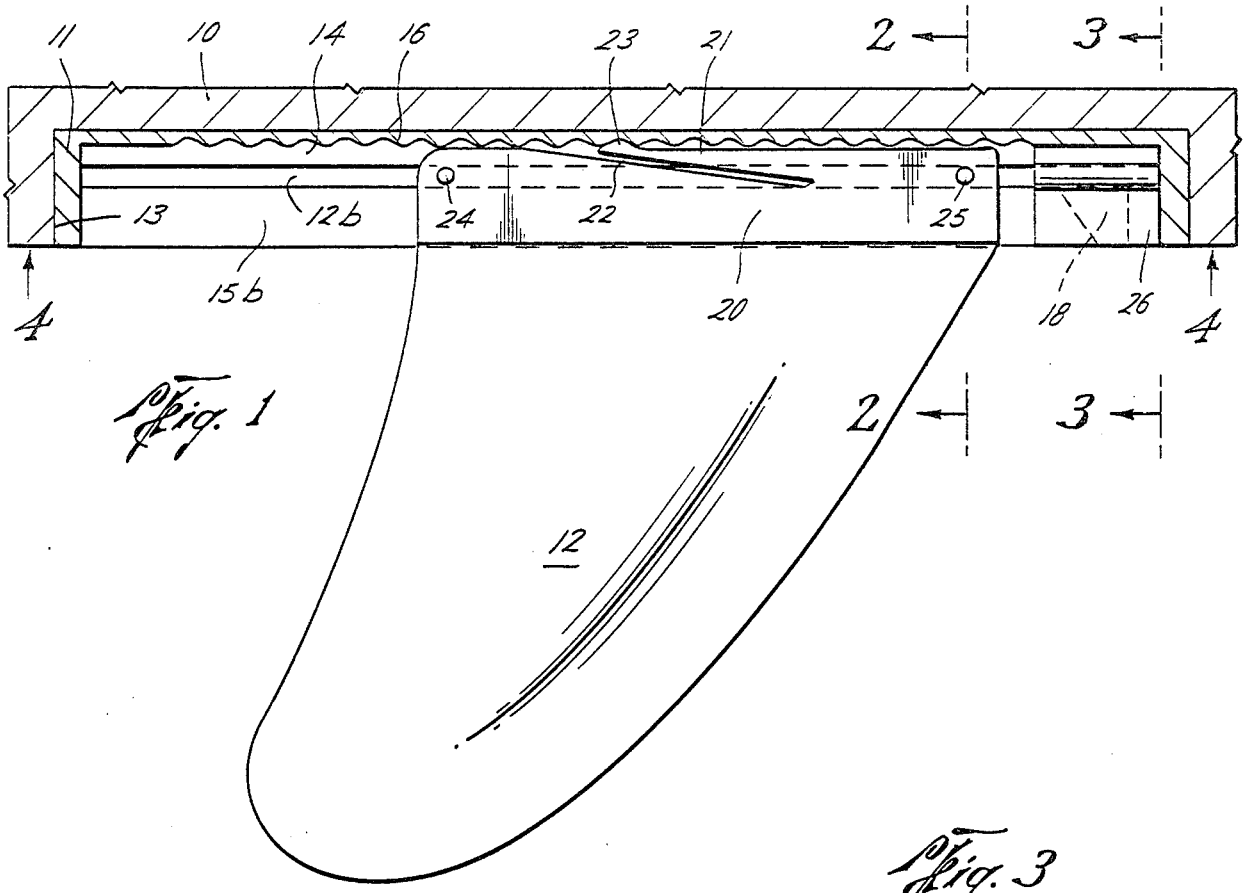
FIG. 1 is a longitudinal cross section board and the fin mounting box with the safety clip and fin inserted.
Figure 2:
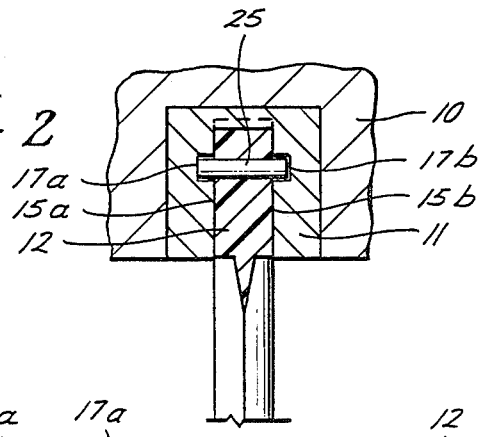
FIG. 2 is a view taken along line 2—2 in FIG. 1.

FIG. 1 shows a cross section of the board 10 and the elongated fin mounting box 11 with the fin 12 shown inserted and positioned for use. The fin mounting box 11 is recessed and firmly bonded or mounted in cavity 13 of board 10 so that the fin mounting box 11 is flush with the underside of board 10. Box 11 has a longitudinally extended channel 14 formed in part by facing sidewalls **15*a* and 15*b* indicated in FIG. 2**.

Figure 4:
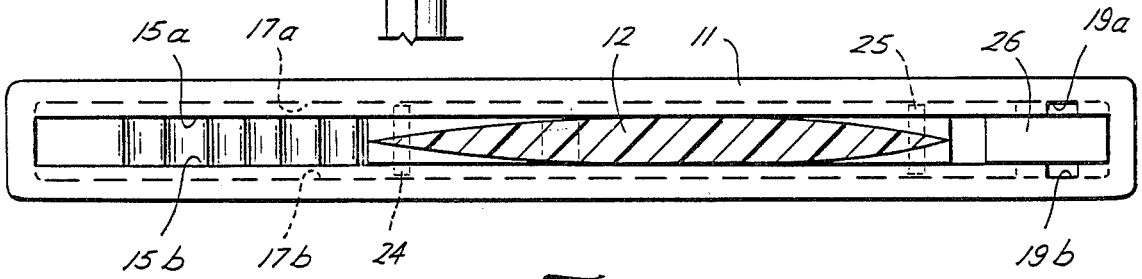
FIG. 4 is a view looking into the mounting box with a cross section of the inserted fin.

Channel 14 has a narrow, longitudinally elongated inner ribbed surface 16 that faces downward when the board is in use. Channel 14 has parallel guide slots 17*a* and 17*b* which extend the length of the channel 14. At one end of the channel 14 the guide slots 17*a* and 17*b* widen in side walls 15*a* and 15*b* to form passage 18. The widened slots forming passage 18 then narrow in width and extend to the surface of box 11 to form entry slots 19*a* and 19*b* shown in FIG. 4.

Fin 12 has a base 20, the width of which is slightly less than the width of the channel 14 to allow sliding of the fin base in the channel. The fin 12 is provided with finger 21 which is created by slot cut 22 at an angle to the fin base 20. Finger 21 has a nodular tip 23. The fin base 20 is made of a polymer or like material so that the resilient finger, which is made by sawing a slot cut in the fin base, resists fatigue. Fin base 20 is provided with guide pins 24 and 25 that extend transversely through either end of the fin base as shown in FIG. 1. The pins can be made of a corrosion proof material such as stainless steel or nylon or other high strength plastic.

Figure 3:
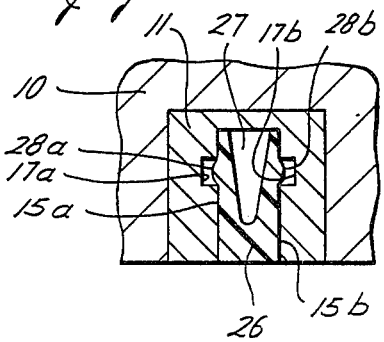
FIG. 3 is a view taken along line 3—3 in FIG. 1.
Figure 5:
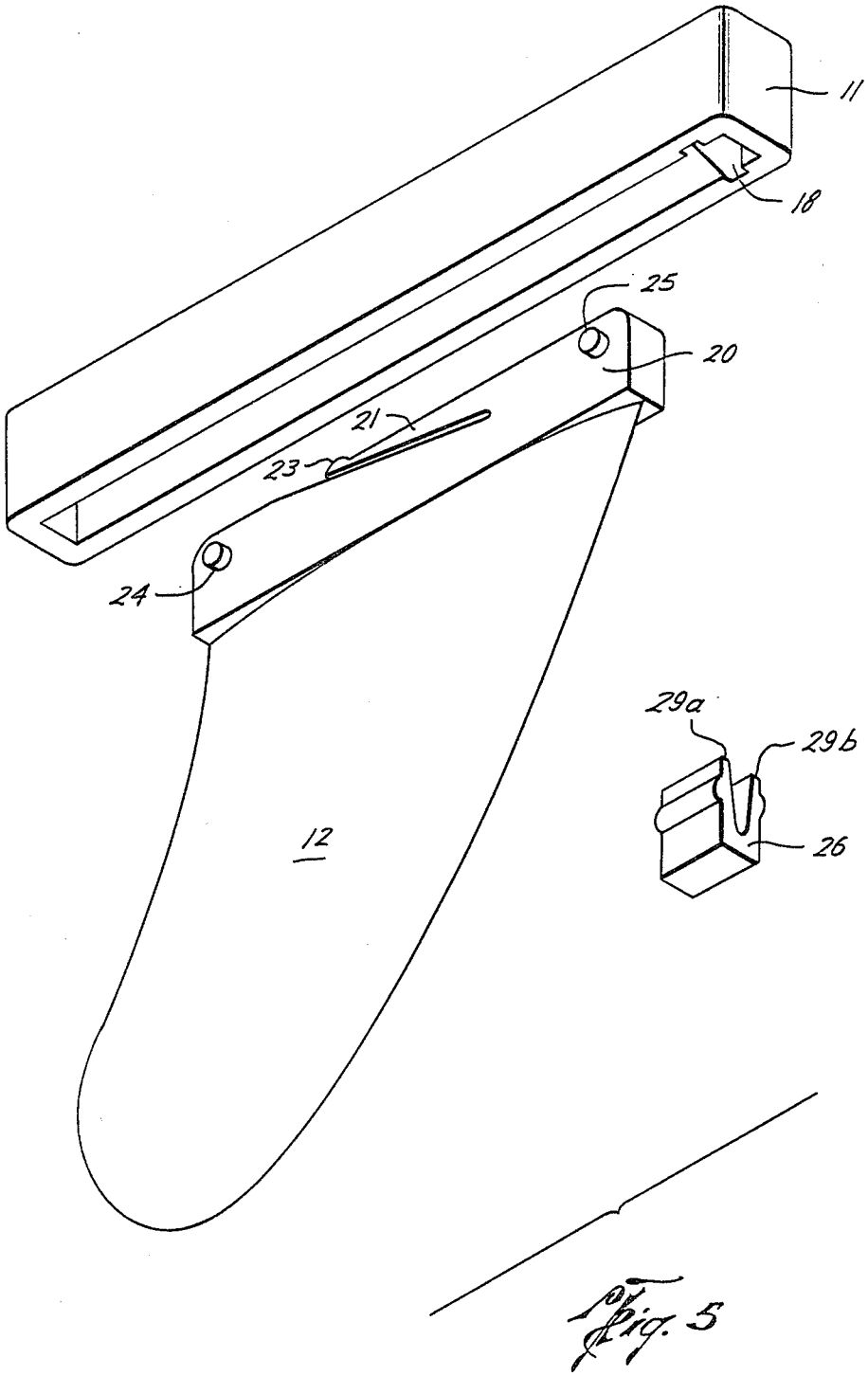
FIG. 5 is an exploded view of the safety clip, fin and mounting box.

The adjustable fin system can also be used with a safety clip 26, generally shown in FIG. 5, as an additional measure to prevent the accidental loss of the fin from the channel. Safety clip 26 is a rectangular plug with a cavity 27 that allows for compression necessary to insert the clip to block passage 18, channel 14 and guide slots 17*a* and 17*b* when in use, as shown in FIG. 3. Safety clip 26 is provided with semicircular enlargements 28*a* and 28*b* which correspond to slots 17*a* and 17*b* and provide an additional measure to block the guide slots. The symmetrical legs 29*a* and 29*b* are formed in clip 26 by cavity 27. The legs are slightly wider than channel 14 and are compressed to insert clip 26 in the passage 18. The legs 29*a* and 29*b* are biased against side walls 15*a* and 15*b* to give a tight lock so that the clip will not be dislodged. Additionally, engagements 28*a* and 28*b* on clip 26 fit into slots 17*a* and 17*b* for additional security. Although the adjustable fin system is quite secure without the use of clip 26, and the clip is not required for use of the adjustable fin system, it provides an extra margin to insure that the fin is not separated from the board. The clip 26 also seals the channel to give a drag-free undersurface during use of the board.

The relatively few components of the adjustable fin assembly described above provide a system which in operation gives the sports enthusiast the features of immediate longitudinal fin adjustment without the use of tools. The fin adjustment can be accomplished in the marine environment. To insert the fin, fin base 20 is placed at an angle relative to box 10 so that guide pin 24 is positioned in inlet slots 19*a* and 19*b* and then into passage 18. Guide pin 24 is then slid into guide slots 17*a* and 17*b*. Pressure is applied to fin base 20 to allow entry of the entire fin base into channel 14 and, in so doing, forces the compression of resilient finger 23 over ribbed surface 16. Guide pin 25 is inserted into inlet slots 19*a* and 19*b*, then through passage 18 and into guide slots 17*a* and 17*b*. At this point the fin is ready for longitudinal adjustment in the channel. This is accomplished by applying pressure on fin 12 near the base 20. Releasing pressure on fin base 20 causes nodular tip 23 of resilient finger 21 to engage one of the notch-like impressions along ribbed surface 16 and positions the fin at the desired point along channel 14. Pressure on any part of fin 12 other than near base 20 will not cause the fin to move along the channel 14.

If desired, the safety clip 26 can be used to block channel 14 and prevent the accidental loss of the fin if it should become dislodged in some manner. The clip is inserted generally in passage 18 at inlet slots 19*a* and 19*b* and blocks the channel 14 as well as guide slots 17*a* and 17*b*. Such placement is shown in FIG. 3. With the safety clip inserted at the inlet passage end of the channel 14, the fin still may be adjusted along the length of the ribbed surface.

To remove the fin, the safety clip is pulled out from the channel. Pressure is asserted on the fin near the base, compressing and forcing resilient finger over ribbed surface 14 and moving the fin along the length of the guide slots 17*a* and 17*b* until guide pin 25 reaches passage 18. The fin is then pulled downward and away from box 10 so that guide pin 25 is withdrawn from the fin box through passage 18 and out of the box at inlet slots 19*a* and 19*b*. Additional pressure is placed on the fin near base 20 and the fin is tilted at an angle so that guide pin 24 is slipped through slots 17*a* and 17*b* to passage 18. The end of the fin base with guide pin 24 is withdrawn from the channel with guide pin 24 exiting through passage 18 and inlet slots 19*a* and 19*b*.

For equipment such as sailboards and some types of surfboards, more than one fin is desirable. Generally, a double fin assembly is installed on the board with two independent fin box assemblies, channels and fins. Each fin is independently adjustable. The channels are generally set at a slight angle to each other and at an angle to the centerline of the board; however, any angle or positioning of the channels on the board may be used. Although the fin configuration as shown in FIGS. 1 and 5 is of a particular shape, this is for the purpose of illustration only. Any shape of fin may be used, provided the fin base is adapted for use with the fin box shown in the present invention. Also, the length of the fin box and channel can be designed to be as long or short as needed for the desired flexibility in adjustment for the particular piece of surfing equipment.

What is claimed is:

1. A fin attachment for surfboard and sailboards comprising:

means defining the ear undersurface as a channel along the longitudinal axis of the board wherein said channel has a ribbed inner surface;

a resilient finger provided on the base of the fin for coacting with said ribbed surface to slidably position and secure the fin along the longitudinal axis of said ribbed surface of such channel;

said fin provided with a slot cut at an angle to the base of the fin to form said resilient finger; and means to receive and retain said fin base in said channel which allows for longitudinal movement of the fin in the channel.

2. A fin attachment for surfboards and sailboards comprising:

a fin mounting box for mounting in a recessed manner on the under surface of the board provided with an elongated channel defined by a pair of longitudinal side walls spaced on either side of the channel with a ribbed surface between said longitudinal side walls;

a resilient finger provided on the base of the fin to engage notch by notch said ribbed surface to securely position the fin along the longitudinal axis of each channel at a preselected position;

said fin provided with a slot cut at an angle to the base of the fin to form said resilient finger; and means to receive and retain said fin base in said channel which allows for longitudinal movement of the fin in the channel.

3. The structure according to claim 2, wherein;

said means to receive and retain said fin base comprises slots in said longitudinal side walls which run parallel to each other and run the length of said mounting box, said slots curving at one end of the channel and extending to the surface of the mounting box; and said fin with at least one pin extending transversely through the base of the fin and sized to be received in said slots.

4. The structure according to claim 2 including: removable means for blocking said channel.

5. The structure according to claim 2 including:

means for sealing said channel to eliminate drag on the undersurface of the board.

6. A fin attachment for surfboards and sailboards comprising:

a fin mounting box substantially recessed flush with the undersurface of the board;

said fin mounting box provided with a longitudinal channel formed by opposite facing side walls with a ribbed surface between said side walls that is parallel to the undersurface of the board, with the ribbed surface facing downward from the board;

said fin with two pins transversely extending the base of the fin and spaced apart form each other at either end of the base of the fin;

said fin provided with a slot cut at an angle to the base of the fin to form a resilient finger;

said channel has longitudinal slots in each side wall running parallel to the channel and the ribbed surface, with the slots extending and curving in said fin mounting box to the surface at one end of the channel of the mounting box; and said slots are sized to receive the transverse pins at the base of the fin with said fin slidably positioned along said channel by applying pressure on the base of the fin, causing said resilient finger to engage notch by notch said ribbed surface until a preselected position of said fin is reached along the length of said channel.

7. The structure according to claim 6 including:

a safety clip which inserts into and blocks the movement of said fin in said channel.

8. A fin attachment for surfboards and sailboards comprising:

a fin with a base;

a fin mounting box substantially recessed flush with the undersurface of the board;

said fin mounting box having a channel with a ribbed inner surface running along the longitudinal axis of the board;

means for receiving the fin base into said channel; and a slot cut at an angle to said fin base to provide a resilient finger at the base which upon compression of the fin engages notch by notch said ribbed inner surface until pressure is released at a preselected point.

* * * * *